United States Patent [19]

Thompson

[11] 4,416,077

[45] Nov. 22, 1983

[54] COMBINATION EXTRACTOR AND HOLD DOWN MECHANISM FOR A BOLT-ACTION RIFLE

[76] Inventor: James G. Thompson, 4655 Butte Falls Hwy., Eagle Point, Oreg. 97524

[21] Appl. No.: 388,272

[22] Filed: Jun. 14, 1982

[51] Int. Cl.[3] ..... F41C 15/00; F41C 11/06

[52] U.S. Cl. ..... 42/25; 42/16

[58] Field of Search ..... 42/25, 16

[56] References Cited

U.S. PATENT DOCUMENTS

| | | | |
|---|---|---|---|
| 2,421,249 | 5/1947 | Delsole | 42/25 |
| 2,803,079 | 8/1957 | Heilman | 42/16 |
| 4,194,314 | 3/1980 | Foote | 42/25 |

FOREIGN PATENT DOCUMENTS

| | | | |
|---|---|---|---|
| 505946 | 5/1939 | United Kingdom | 42/16 |

*Primary Examiner*—Charles T. Jordan
*Assistant Examiner*—Ted L. Parr
*Attorney, Agent, or Firm*—James D. Givnan, Jr.

[57] ABSTRACT

A bolt assembly includes a locking lug bored to slidably receive both a bolt hold down plunger and a cartridge extractor pin jointly actuated by an interposed coil spring. An extractor is rockably mounted adjacent the bolt forward end and urged by the extractor pin into gripping engagement with a cartridge rim for extracting same from the gun barrel chamber. The extractor includes a stem loosely received in a bolt defined recess.

6 Claims, 3 Drawing Figures

COMBINATION EXTRACTOR AND HOLD DOWN MECHANISM FOR A BOLT-ACTION RIFLE

BACKGROUND OF THE INVENTION

The present invention pertains generally to rifle bolt actions and particularly to a bolt action incorporating an extractor and a bolt hold down plunger actuated by a common component.

Conventional bolt assembly construction includes spring biased extractor means for removing an empty cartridge casing from the barrel chamber. Additionally found in conventional rifle bolt assemblies is a hold down mechanism which maintains the bolt against rotational unlocking movement until a positive manual force is exerted on the bolt arm to initiate bolt retraction. Typically, these components of the bolt assembly are entirely independent of one another and require separate machining and assembly operations.

SUMMARY OF THE PRESENT INVENTION

The present invention is embodied within the bolt assembly of a bolt-action rifle which assembly includes a casing extractor and a bolt hold down plunger acted upon by a common component.

The bolt assembly includes a locking lug which rotates in the usual manner into locking abutment with an upright surface of the rifle receiver. Said wall surface is recessed at a point therealong to receive a plunger element carried by the locking lug and biased into the recess by a spring component. The spring component additionally serves to bias an extractor which functions to engage and extract the spent casing from the barrel chamber. The rifle bolt is machined to permit the extractor to rock rearwardly to permit ejection of the casing upon contact with the bolt firing pin during opening of the action.

Important objects of the present invention include the provision of a rifle bolt assembly of simplified construction providing both bolt hold down and extractor features utilizing a common resilient member carried by a bolt locking lug; the provision of a rifle bolt assembly having a hold down plunger and a casing extractor which components are coupled to the rifle bolt without pins, keys, etc.,; the provision of an extractor carried by a rifle bolt assembly in a manner permitting the extractor to rock outwardly away from a casing rim in response to casing displacement by the bolt assembly firing pin during opening of the rifle action.

DETAILED DESCRIPTION OF THE PREFERRED EMBODIMENT

Figure 1:
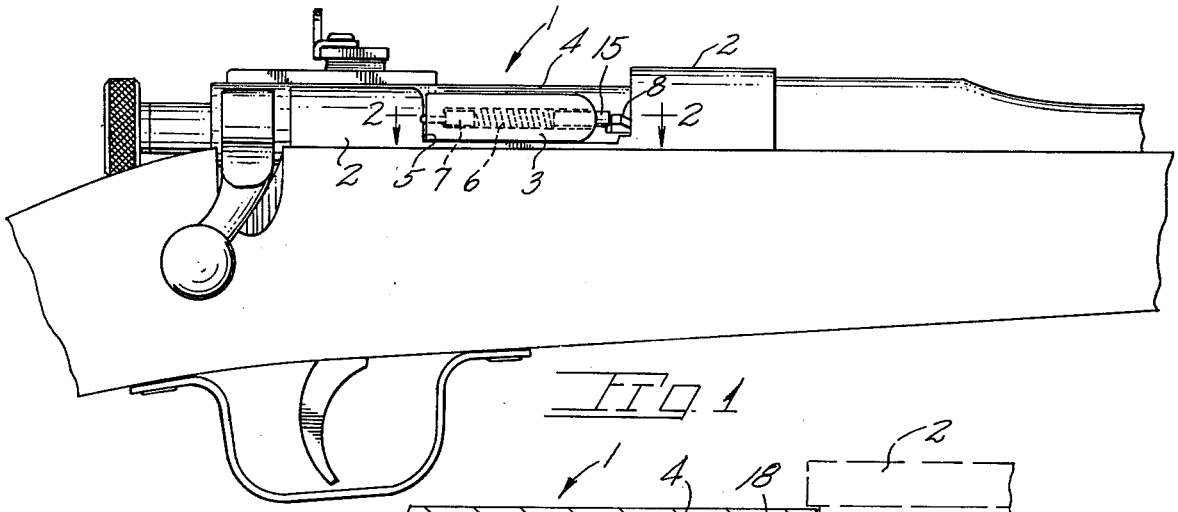
FIG. 1 is a side elevational fragmentary view of a bolt-action rifle.

With continuing attention to the drawing wherein applied reference numerals indicate parts similarly hereinafter identified, the reference numeral 1 indicates generally the bolt assembly of a bolt-action rifle.

The bolt assembly is slidably carried within a receiver 2 in the usual manner with a locking lug at 3 on the main bolt member 4 being engageable with a receiver edge surface at 5.

The locking lug defines a lengthwise extending bore 3A within which is housed helical spring 6 which bears at one end on a bolt hold down plunger 7 to seat the outer end 7A of same into a recess 5A in receiver surface 5. End 7A of the plunger is rounded so as to permit the receiver surfaces to act in the manner of a cam on the plunger during rotational movement of the locking lug. Plunger 7 retains the bolt against accidental unlocking movement.

A retractor at 8 is yieldably mounted adjacent the forward end of bolt member 4 by means of an extractor stem 13 being loosely confined in a recess 10 extending radially of the bolt axis. Recess 10 is in communication with a slotted opening 11 extending rearwardly from the front face 12 of the bolt main member. A casing at C, shown as being of the rim fire type, seats within a shallow recess in the bolt face.

Figure 2:
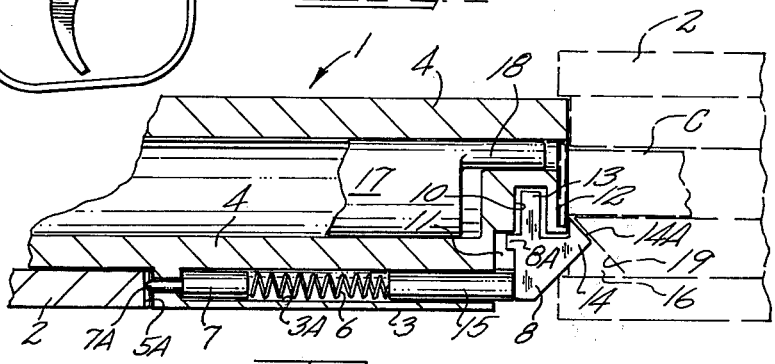
FIG. 2 is a horizontal sectional view taken approximately along line 2—2 of FIG. 1.
Figure 3:
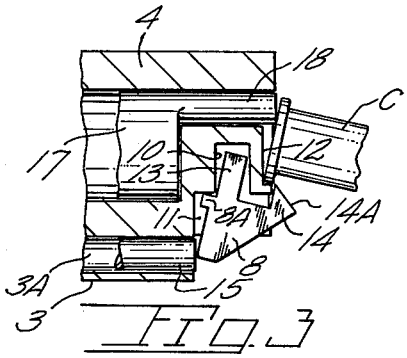
FIG. 3 is a horizontal sectional view of the bolt assembly in an open position whereat the bolt assembly firing pin ejects the spent casing.

Extractor stem portion 13 is received within oversized recess 10 to permit limited radial displacement of the extractor as when the bolt is driven home to the FIG. 2 position. An inclined edge 14A of a tang 14 of the extractor, upon contact with the cartridge rim, causes the extractor to momentarily move radially and thereafter the tang to seat on the forward side of the cartridge rim. At all times a spring biased extractor pin 15, slidably carried in the locking lug bore 3A, urges the extractor in a forward direction. The extractor is confined against lateral displacement by the adjacent parallel walls defining the rearwardly extending slot-like opening 11. A chamber 16 of the rifle barrel end is inclined at 19 to accept the extractor tang.

During extraction of the casing, the rearward edge of the tang bears upon the carriage rim to hold same within the shallow recess in the bolt front face.

A firing pin at 17 is carried within the bolt assembly main member and is released during firing by a trigger actuated sear, not shown. The sear additionally serves later to provide an abutment against which the firing pin abuts during rearward travel of the bolt assembly to cause a firing pin stud at 18 to project forwardly through the bolt face and unseat the cartridge in a manner normally causing same to be ejected from the receiver area. Using the firing pin to impart ejection motion to an empty casing is admittedly old.

Retractor 8 rocks about a shoulder portion formed by the main portion of the tang and a rearwardly directed projection at 8A.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. In a bolt assembly for a bolt-action rifle, said assembly including a bolt main body member, a firing pin slidably housed within said main body member, the improvement comprising, a locking lug on said main body member, said lug defining a bore, a bolt hold down plunger slidably carried within said bore, an extractor pin also slidably carried within said bore, resilient means biasing said plunger and said extractor pin in opposite directions, an extractor rockably carried adjacent the forward end of the bolt main body member and acted upon by said extractor pin for biasing the extractor into engagement with the rim of a cartridge casing whereby the cartridge shell is confined into abutment with the bolt main body member during extraction of the casing from a gun barrel.

2. The improvement claimed in claim 1 wherein said resilient means is a helical spring acting jointly on said plunger and said extractor pin.

3. The improvement claimed in claim 2 wherein said extractor includes a shoulder portion providing a surface about which the extractor may rock.

4. A bolt assembly for a bolt-action rifle, said assembly including, a bolt main body member including a locking lug defining a bore, a hold down plunger slidably mounted within said locking lug, an extractor pin also slidably mounted within said locking lug, resilient means biasing said hold down plunger and said extractor pin in opposite directions, and an extractor movably mounted adjacent one end of said bolt main body member, said extractor pin in biased engagement with said extractor for urging same into engagement with the rim of a cartridge casing for withdrawing of the cartridge casing from a rifle barrel chamber.

5. The bolt assembly claimed in claim 4 wherein said resilient means acts jointly on said hold down plunger and said extractor pin.

6. The bolt assembly claimed in claim 5 wherein said extractor includes a shoulder portion providing a surface about which the extractor may rock.

* * * * *